United States Patent [19]

Schlenker

[11] 4,227,359

[45] Oct. 14, 1980

[54] ADJUSTABLE SINGLE UNIT MASONRY REINFORCEMENT

[75] Inventor: Robert W. Schlenker, Baltimore, Md.

[73] Assignee: National Wire Products, Baltimore, Md.

[21] Appl. No.: 962,620

[22] Filed: Nov. 21, 1978

[51] Int. Cl.[2] ..... E04B 2/30

[52] U.S. Cl. ..... 52/713; 52/562; 52/428

[58] Field of Search ..... 52/712–715, 52/428, 562, 568, 357–360, 56

[56] References Cited

U.S. PATENT DOCUMENTS

| | | | |
|---|---|---|---|
| 1,280,173 | 10/1918 | Cutler | 52/712 |
| 2,058,364 | 10/1936 | Sorenson | 52/340 |
| 2,174,844 | 10/1939 | Sedore | 52/307 |
| 3,277,626 | 10/1966 | Brynjolfsson et al. | 52/428 |
| 3,292,336 | 12/1966 | Brynjolfsson et al. | 52/713 |
| 3,300,939 | 1/1967 | Brynjolfsson et al. | 52/713 |
| 3,309,828 | 3/1967 | Tribble | 52/713 |
| 3,341,998 | 9/1967 | Lucas | 52/713 |
| 3,353,312 | 11/1967 | Storch | 52/713 |
| 3,377,764 | 4/1968 | Storch | 52/713 |
| 3,918,227 | 11/1975 | Gaston | 52/562 |
| 3,964,226 | 6/1976 | Hala et al. | 52/562 |
| 3,964,227 | 6/1976 | Hala | 52/713 |
| 4,021,990 | 5/1977 | Schwalberg | 52/714 |

*Primary Examiner*—James L. Ridgill

*Attorney, Agent, or Firm*—Brady, O'Boyle & Gates

[57] ABSTRACT

A preassembled unitized masonry reinforcement for cavity walls or composite walls utilizes a ladder or truss-type block mesh and suitable numbers of standard length corrugated metal wall ties pivotally and slidably connected in permanently assembled relationship to block mesh members, whereby the wall ties may be freely adjusted by pivotal and/or sliding movements to the most advantageous positions of use and similarly may be positioned for shipment entirely or nearly within the boundaries of the block mesh reinforcement. Various wall tie configurations by bending of ties can be achieved to compensate for misalignment of mortar joints in composite or cavity walls. The hinge or pivot joints between ties and reinforcing mesh members are mortar locked within bed joints of the wall for added security.

13 Claims, 12 Drawing Figures

FIG. 1
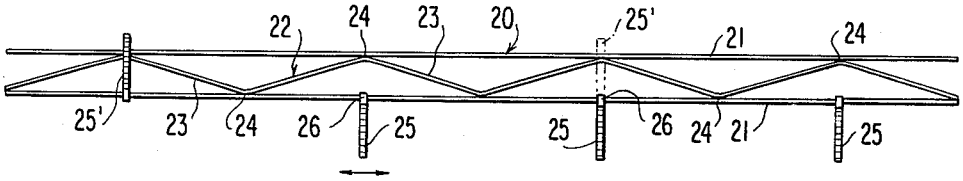
FIG. 2
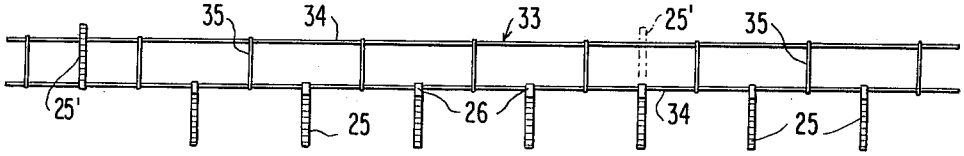
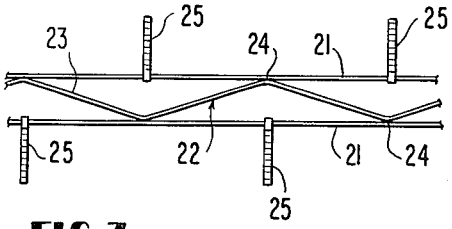
FIG. 3
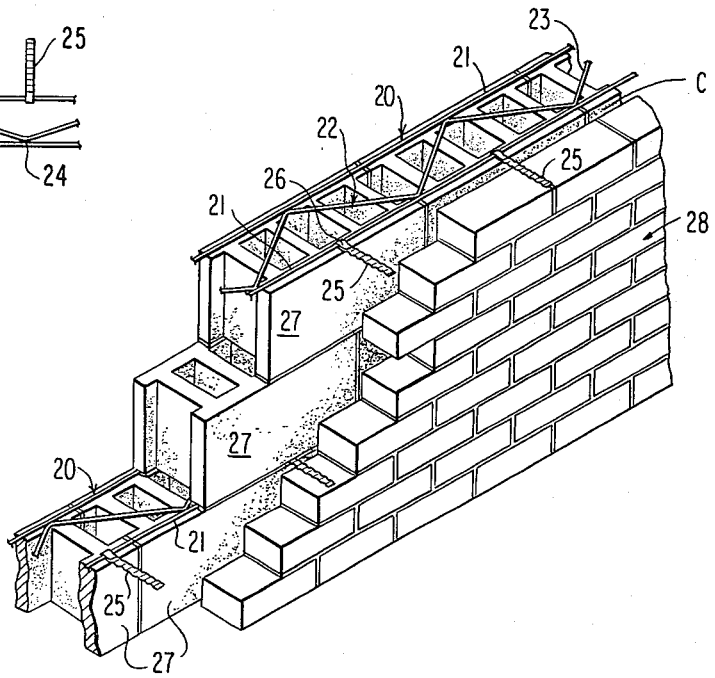
FIG. 4
FIG. 5
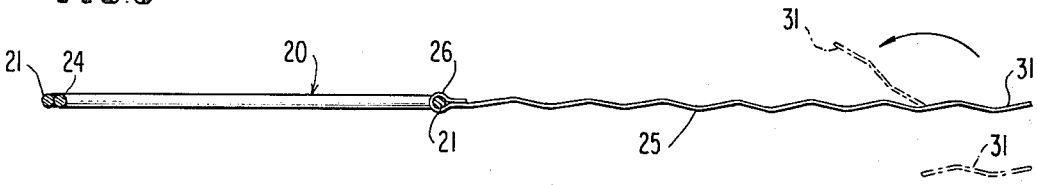
FIG. 6
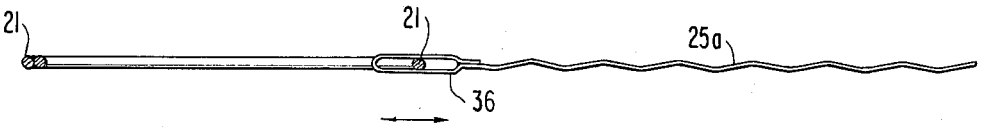

FIG. 7
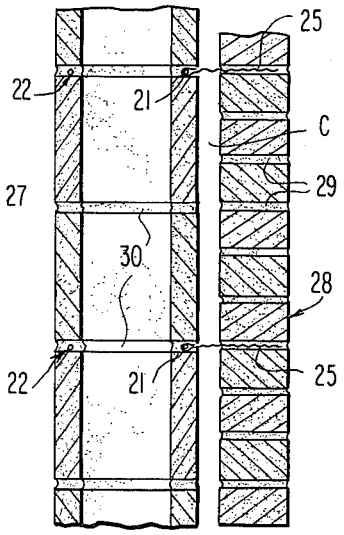
FIG. 8
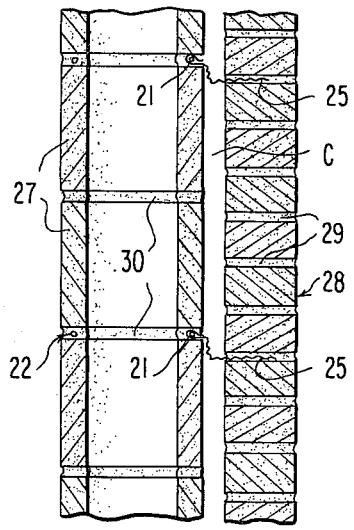
FIG. 9
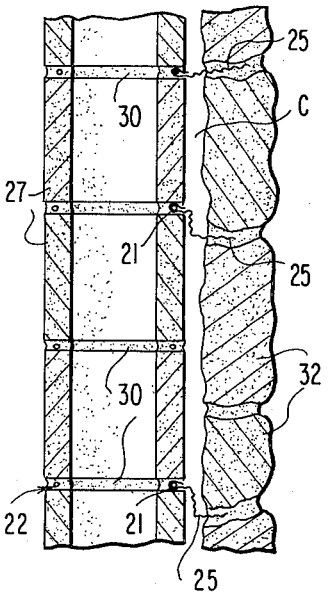
FIG. 10
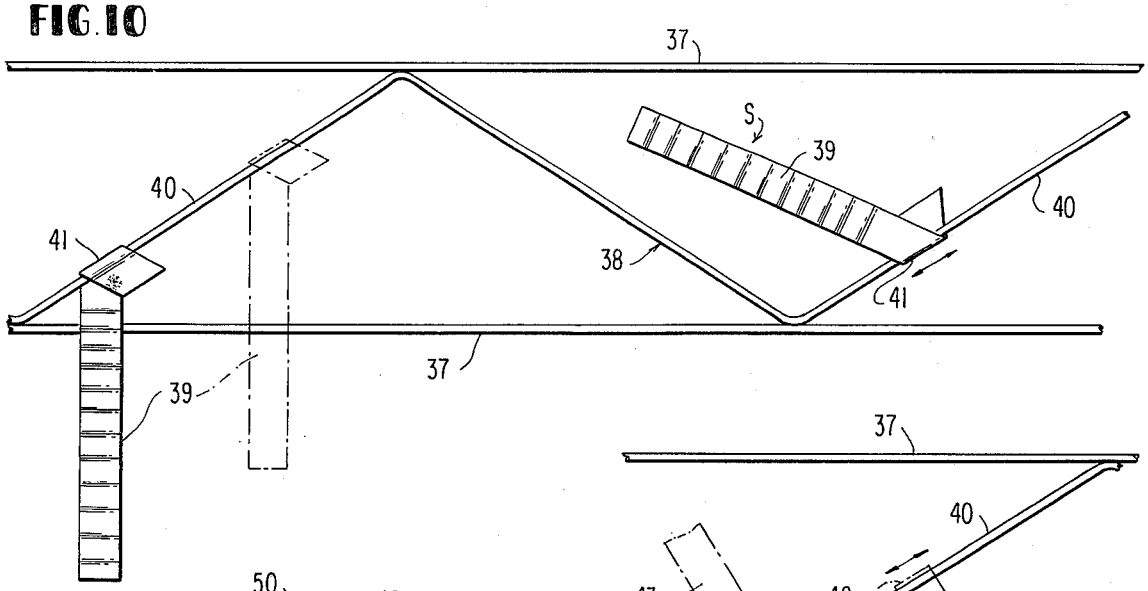
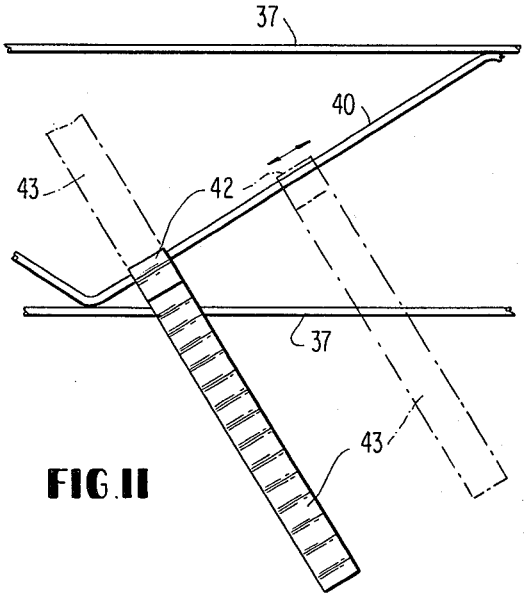
FIG. 11
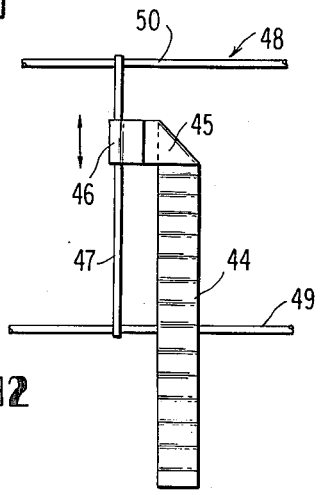
FIG. 12

ADJUSTABLE SINGLE UNIT MASONRY REINFORCEMENT

BACKGROUND OF THE INVENTION

Delayed delivery of brick to masonry construction sites has caused many contractors to proceed with the construction of back-up wythes in composite and cavity walls to maintain construction schedules. If reinforcement to tie back-up and exterior wythes together is required it is normally installed in the bed joints of the back-up wythe and remains protruding from this wythe. When the brick is finally delivered, the exterior wythe is constructed and serious difficulties are encountered by the bricklayers in attempting to maintain specified mortar bed thickness and alignment of mortar joints in the exterior wythe with the protruding reinforcings of the back-up wythe. These and other problems have stimulated a demand in recent times for adjustable masonry reinforcing means and to satisfy this demand, a number of prior art reinforcing systems have been devised. The following United States patents pertaining to such reinforcing systems are made of record herein under 37 C.F.R. 1.56:

U.S. Pat Nos. 1,280,173, 3,341,998, 2,174,844, 3,353,312, 3,277,626, 3,377,764, 3,292,336, 3,918,227, 3,300,939, 3,964,226, 3,309,828, 3,964,227, 4,021,990.

A major deficiency in the known prior art lies in the provision of adjustable components including ties which are not preassembled permanently to the block mesh, but instead are in the nature of attachment elements which are connected to the block mesh and adjusted relative to the mesh on the construction job site. Such add-on "bits and pieces" are easily mislaid or lost in shipment or on the job site, adding to the complexity of the problem as well as inconvenience and increased cost to contractors. Another drawback of the prior art is the excessive complexity and cost of some proposed reinforcing systems and a general lack of uniformity or standardization of parts.

The present invention has for its primary object the complete overcoming of the above prior art deficiencies through the provision of an essentially standardized and readily adjustable masonry reinforcing system in which the parts are prefabricated in permanently assembled relationship and the overall construction of the system is extremely simplified and economical to manufacture and to install at the construction site. The reinforcing system according to the invention involves the utilization of standard commercial components including corrugated ties which are both pivotally and slidably assembled onto appropriate members of the block mesh in either truss or ladder styles of mesh. The multiple ties are freely adjustable on the block mesh to the most advantageous positions of use in wall structures and are also movable to retracted shipping or storage positions nearly or entirely within the boundaries of the block mesh to form a compact, integral shipping unit. In the invention, there is no fear of separation of the ties at any time from the reinforcing mesh, thus totally eliminating one of the major drawbacks of the prior art.

The necessary compensations for spacing between the wythes and cavity walls and for misalignment of mortar joints in back-up and exterior wythes is readily achieved by bending the corrugated wall ties during the construction of walls and sometimes trimming off end portions of ties.

Another advantage of the invention lies in its great versatility in its ability to meet the needs of particular installations in which requirements vary over a wide range. The corrugated ties can be attached pivotally and slidably either to longitudinal members or diagonal brace members in truss-type block mesh to achieve versatility and the angular relationship of the longitudinal axis of the tie to its pivot axis may also be varied.

Other features and advantages of the invention will become apparent to those skilled in the art during the course of the following description.

BRIEF DESCRIPTION OF THE DRAWINGS

FIG. 1 is a fragmentary plan view of a masonry reinforcement assembly according to one embodiment of the invention.

FIG. 2 is a similar plan view showing a second embodiment of the invention.

FIG. 3 is a fragmentary plan view showing a variant of the embodiment shown in FIG. 1.

FIG. 4 is a fragmentary perspective view of a cavity wall utilizing the invention as depicted in FIG. 1.

FIG. 5 is an enlarged transverse cross section taken through the reinforcement as depicted in FIG. 1.

FIG. 6 is a sectional view similar to FIG. 5 showing a modified connection between a bendable wall tie and a block mesh member to which the tie is pivotally and slidably connected.

FIGS. 7 through 9 are cross sectional views through cavity walls showing the ability of the bendable ties to compensate for mortar joint misalignment between wythes.

FIG. 10 is a fragmentary plan view of a reinforcement assembly according to a further modification.

FIG. 11 is a similar view showing a variant of the arrangement shown in FIG. 10.

FIG. 12 is a fragmentary plan view of a reinforcement assembly according to another modification.

DETAILED DESCRIPTION

Referring to the drawings in detail wherein like numerals designate like parts, a block mesh wall reinforcing assembly 20 of the truss type is shown in FIG. 1 including parallel longitudinal rod members 21 interconnected in a common plane by a zigzag brace 22 having multiple equal length diagonal sections 23. The brace 22 is welded to the parallel rod members 21 at the recurring apices 24 of the brace 22. A suitable number of equal length corrugated metal wall ties 25 are attached pivotally and slidably to one longitudinal member 21 for ready adjustment on the block mesh 20. Referring to FIG. 5, each corrugated tie 25, which is a standard commercial element, has a closed loop 26 formed on one end thereof and embracing the longitudinal rod member 21 both pivotally and slidably along the length of the member 21, as indicated by the arrows in FIG. 1. An important feature of the invention thus far described, distinguishing it from the prior art, is the fact that the ties 25 are permanently assembled on the block mesh 20 during manufacturing to completely avoid the use of separate add-on components likely to become lost during shipment or at the job site, as previously discussed. Thus, the components of the adjustable masonry reinforcement according to the invention are permanently assembled and no loose parts whatsoever are involved.

In FIG. 1, for the sake of illustration, one adjustable wall tie 25' is positioned across the block mesh in the shipping or storage position so as to lie nearly inside of the boundaries of the block mesh. This important feature of the invention prevents damaging of the ties 25 during shipment.

As shown in FIG. 4, a back-up wythe of building blocks 27 can first be constructed and in every bed joint of the back-up wythe 27 one of the reinforcing assemblies 20 is placed so that the block mesh composed of the elements 21 and 22 and the pivotal connections for the ties including their loops 26 are embedded in the mortar of the bed joints between courses of the back-up wythe. When the assemblies 20 are so positioned in the back-up wythe, the several corrugated ties 25 are preadjusted pivotally and longitudinally on the member 21 carrying them so that the specified spacing of the ties can be achieved with the ties projecting forwardly of the back-up wythe and through the wall cavity C for ready entry in the mortar joints of the external brick wythe 28 at such time as the brick wythe is constructed.

FIGS. 7, 8 and 9 of the drawings show the ability of the bendable corrugated ties 25 to meet variations in the location of the bed joints 29 of the external wythe 28 relative to the bed joints 30 in the back-up wythe. In some cases, FIG. 7, the respective bed joints 29 and 30 may be substantially aligned, in which case no bending of the ties 25 is required except for establishing their proper lengths dictated mainly by the width of the cavity C. For this purpose, end portions 31 of the ties 25 may be bent completely back upon the bodies of the ties or, in some cases, may be trimmed off, as illustrated in FIG. 5, in order to attain the required length of tie.

FIG. 8 illustrates that the corrugated ties 25 may be bent to compensate for misalignment of the joints 29 and 30 so as to produce an offset or stepped configuration of the ties above or below the bed joints 30 depending upon circumstances. Portions of the bent ties 25 will thus extend into the cavity C with the main bodies of the ties anchored in the bed joints 29.

FIG. 9 reflects the further adaptability of the reinforcing system to cavity walls wherein the exterior wythe is formed of irregular shaped stones 32. In all cases, the entire block mesh composed of elements 21 and 22 including the connecting loops 26 of the ties 25 are locked in the mortar of the bed joints, as illustrated.

FIG. 2 of the drawings shows a second embodiment of the invention in which the assembly comprises a block mesh unit 33 of the ladder type including parallel longitudinal rods 34 and equidistantly spaced welded right angular "rung" braces 35. The corrugated metal strip ties 25, previously described in detail, are pivotally and slidably mounted on one rod 34 of the block mesh for use in substantially the same manner described previously for the embodiment shown in FIG. 1.

FIG. 3 shows a variant of the arrangement shown in FIG. 1, the only difference being that the wall ties 25 are provided in alternating or staggered relationship on both longitudinal rods 21 pivotally and slidably. This arrangement can be employed when desired for structurally tying together two adjacent wythes. The ties 25 on both sides of the block mesh in FIG. 3 are swingable to shipping positions across and substantially within the boundaries of the block mesh.

FIG. 6 shows a modification in the construction of the corrugated metal strip tie 25*a*. In this instance, the circular loop 26 forming the connection with one rod 26 is replaced by a considerably elongated flat loop 36 which allows limited adjustment of the tie 25*a* lengthwise and across the rod 21, in addition to pivotal adjustment around the axis of the rod 21 and sliding adjustment longitudinally of the rod.

FIG. 10 shows another embodiment of the invention in which a truss-type block mesh unit composed of longitudinal rods 37 and a welded truss brace 38 has corrugated metal strip ties 39 pivotally and slidably attached permanently to diagonal sections 40 of the brace 38. The longitudinal axes of the ties 39 are at an acute angle to the axes of the tie attachment loops 41, whereby, when the ties are swung to shipping positions as indicated at S in FIG. 10, the ties lie completely inside of the boundaries of the reinforcement to protect the ties from damage in shipment. FIG. 10 also shows in full lines and broken lines how ties 39 can be slidably adjusted along the diagonal brace sections 41 to vary their projection distances laterally of the rod 37 and to vary their locations lengthwise of the reinforcement structure.

FIG. 11 shows a slight variation of the arrangement in FIG. 10 wherein the attaching loops 42 of the corrugated ties 43 have their axes at right angles to the longitudinal axes of the ties. Thus, when the ties 43 are in active use positions, they form acute angles with one rod 37 and project across and outwardly of such rod varying distances depending upon their adjustments along brace sections 40. In all embodiments, it should be noted that during active use of the ties their connections with the reinforcing block mesh are embedded in the mortar of the bed joints 30.

FIG. 12 shows still another variation of the invention in which corrugated ties 44 are twisted near one end to form short right angular extensions 45 having attaching loops 46 formed thereon and slidably and pivotally receiving the rung braces 47 of a ladder-type block mesh reinforcement 48. The axes of the loops 46 are parallel to the longitudinal axes of the ties and the ties cross the longitudinal rod 49 of the reinforcement at right angles and are adjustable lengthwise of the rung braces 47. For shipment, the loops 46 are retracted into contact with the far side longitudinal rod 50.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. An adjustable prefabricated masonry reinforcing unit comprising a block mesh reinforcement body portion of the truss type including parallel longitudinal rod members rigidly interconnected in a substantially common plane by cross-connecting rod members, said parallel longitudinal rod members defining the side boundaries of the width of said body portion, said body portion being of a width adapted for placement wholly within a bed joint of one wythe in a wall structure, and a plurality of elongated corrugated strip ties pivotally and slidably connected through closed loops in permanently assembled relationship with at least one of said rod members of said body portion with said pivotal and slidable closed loop connections positioned on said at least one of said rod members for placement bodily within the bed joint of said one wythe, said ties being independently adjustable lengthwise of the body portion and also being independently adjustable laterally of the body portion to vary their distances of projection outwardly of one of said longitudinal rod members defining the longitudinal side boundaries of the body portion, said ties following their adjustments on the body portion being engageable in bed joints of a second wythe in a wall structure, and said ties being independently shiftable through said closed loop connections to protected shipping positions on the body portion where the ties are located substantially within the side boundaries of the body portion formed by said parallel longitudinal rod members and substantially in said common plane of the body portion forming a compact, integral shipping unit.

2. An adjustable prefabricated masonry reinforcing unit as defined in claim 1, and each corrugated strip being formed of bendable sheet metal whereby said distances of projections of the ties beyond one longitudinal side boundary of the body portion may be varied by bending the ties transversely of their longitudinal axes at one or more points.

3. An adjustable prefabricated masonry reinforcing unit as defined in claim 1, and said ties being pivotally and slidably connected in permanently assembled relationship with both of said parallel rod members defining the side boundaries of said body portion.

4. An adjustable prefabricated masonry reinforcing unit as defined in claim 1, and said ties being pivotally and slidably connected in permanently assembled relationship with one of said parallel longitudinal rod members defining one longitudinal side boundary of said body portion with the longitudinal axes of the ties substantially normal to the axis of said one parallel longitudinal rod member.

5. An adjustable prefabricated masonry reinforcing unit as defined in claim 1, in which said cross-connecting rod members comprise zigzag brace rod members.

6. An adjustable prefabricated masonry reinforcing unit as defined in claim 1, in which said cross-connecting rod members comprise plural spaced cross braces substantially at right angles to said parallel longitudinal rod members.

7. An adjustable prefabricated masonry reinforcing unit as defined in claim 1, and said connecting closed loops being substantially circular loops.

8. An adjustable prefabricated masonry reinforcing unit as defined in claim 1, and said connecting closed loops comprising elongated substantially flat closed loops by means of which each tie can be independently adjusted lengthwise across the at least one of said rod members of the body portion on which the closed loops are mounted.

9. An adjustable prefabricated masonry reinforcing unit as defined in claim 1, and said cross-connecting rod members being plural diagonally arranged brace elements, and said ties having end connecting closed loops which are rotationally and slidably mounted on said brace elements.

10. An adjustable prefabricated masonry reinforcing unit as defined in claim 9, and said connecting closed loops of said ties having axes arranged at oblique angles to the longitudinal axes of the ties.

11. An adjustable prefabricated masonry reinforcing unit as defined in claim 9, and said connecting closed loops of said ties having axes arranged at right angles to the longitudinal axes of the ties.

12. An adjustable prefabricated masonry reinforcing unit as defined in claim 6, and said ties having body portions which are substantially parallel to said cross braces and having substantially right angular end extensions terminating in attaching closed loops which are mounted rotationally and slidably on the cross braces, whereby the distances of projection of ties laterally outwardly of one longitudinal side boundary of said body portion may be varied by shifting the ties longitudinally of the cross braces.

13. An adjustable prefabricated masonry reinforcing unit as defined in claim 12 in which said body portion of said ties are rotatable substantially 180° about said cross braces from positions on one side of the cross braces to positions on the opposite side of the cross braces to shift said ties longitudinally of the parallel longitudinal rod members.

* * * * *

UNITED STATES PATENT AND TRADEMARK OFFICE

CERTIFICATE OF CORRECTION

PATENT NO. : 4,227,359

DATED : October 14, 1980

INVENTOR(S) : Robert W. Schlenker

It is certified that error appears in the above-identified patent and that said Letters Patent are hereby corrected as shown below:

In the Heading of the patent, at [73], the name of the Assignee is changed from "National Wire Products", to --National Wire Products Corporation of Md.--.

Signed and Sealed this

*Seventeenth* Day of *February 1981*

[SEAL]

*Attest:*

RENE D. TEGTMEYER

*Attesting Officer*

*Acting Commissioner of Patents and Trademarks*